US005961370A

United States Patent [19]

Valle et al.

[11] Patent Number: 5,961,370

[45] **Date of Patent: *Oct. 5, 1999**

[54] INTRAOCULAR LENS TUMBLING PROCESS USING COATED BEADS

[75] Inventors: Moises A. Valle, Tustin Ranch; Akira Yamada, Claremont; Robert James Kellar, Yorba Linda, all of Calif.

[73] Assignee: Chiron Vision Corporation, Claremont, Calif.

[ * ] Notice: This patent is subject to a terminal disclaimer.

[21] Appl. No.: 08/848,458

[22] Filed: May 8, 1997

[51] Int. Cl.[6] ..... B24B 31/00

[52] U.S. Cl. ..... 451/35; 451/32; 451/329

[58] Field of Search ..... 451/32, 35, 104, 451/113, 326, 328, 330, 329

[56] References Cited

U.S. PATENT DOCUMENTS

| | | |
|---|---|---|
| 2,084,427 | 6/1937 | Broderson . |
| 2,380,653 | 7/1945 | Kopplin . |
| 2,387,034 | 10/1945 | Milano . |
| 2,947,124 | 8/1960 | Madigan et al. . |
| 3,030,746 | 4/1962 | Firestine et al. . |
| 3,656,921 | 4/1972 | Wilcox . |
| 3,816,107 | 6/1974 | Searight et al. . |
| 3,876,450 | 4/1975 | Tanner . |
| 4,110,085 | 8/1978 | Balz . |
| 4,485,061 | 11/1984 | Akhavi et al. . |
| 4,541,206 | 9/1985 | Akhavi . |
| 4,551,949 | 11/1985 | Akhavi et al. . |
| 4,580,371 | 4/1986 | Akhavi . |
| 4,668,446 | 5/1987 | Kaplan et al. . |
| 4,788,080 | 11/1988 | Hojo et al. . |
| 4,856,234 | 8/1989 | Goins . |
| 4,911,190 | 3/1990 | Sheldon . |
| 5,074,908 | 12/1991 | Boswell et al. . |
| 5,104,590 | 4/1992 | Blake . |
| 5,133,159 | 7/1992 | Nelson . |
| 5,185,107 | 2/1993 | Blake . |
| 5,249,395 | 10/1993 | Yoshida . |
| 5,378,449 | 1/1995 | Martin et al. . |
| 5,571,558 | 11/1996 | Nguyen et al. . |
| 5,649,988 | 7/1997 | Valle et al. . |

FOREIGN PATENT DOCUMENTS

| | | |
|---|---|---|
| 1144076 | 4/1958 | Germany . |
| 1596833 | 11/1970 | Germany . |
| 354126 | 3/1991 | Japan . |
| WO9306967 | 4/1993 | WIPO . |

*Primary Examiner*—Eileen P. Morgan
*Attorney, Agent, or Firm*—Pillsbury Madison & Sutro LLP

[57] ABSTRACT

A method of processing a soft or foldable lens includes a step of tumbling (grinding) the lens in a tumbling medium. The tumbling medium includes a mixture of glass beads coated with an abrasive material, alcohol and water. This process applies to single piece and multipiece soft lenses.

26 Claims, 2 Drawing Sheets

INTRAOCULAR LENS TUMBLING PROCESS USING COATED BEADS

BACKGROUND OF THE INVENTION

1. Field of the Invention

The present invention relates to manufacturing processes for soft or foldable intraocular lenses (IOLs) and soft or foldable IOLs manufactured according to such processes involving at least one tumbling step in which soft or foldable lenses are tumbled with beads coated with an abrasive material.

2. Related Art

Methods of molding articles, including lenses, from a moldable material such as plastic, have been practiced for quite some time. A common problem associated with molding and other lens manufacturing processes is the formation of excess material or flash, sharp edges and/or other irregularities in the article. Depending upon the type of article formed in the manufacturing process and the manner in which the article is used, the existence of excess material or flash and/or other irregularities or sharp edges can be undesirable.

Prior methods of removing flash from articles include such labor intensive processes as manually cutting the flash with a blade or scissors. However, such cutting methods can be extremely time consuming and expensive, especially when a large number of articles are being manufactured.

Methods of removing flash and other irregularities by tumbling the article in a rotatable tumbling container have been successfully practiced. For example, U.S. Pat. No. 2,084,427 to Boderson and U.S. Pat. No. 2,387,034 to Milano describe methods of making plastic articles, buttons in particular, which include steps of tumbling the articles to remove projections of excess material or flash. Similarly, U.S. Pat. No. 4,485,061 to Akhavi et al. describes a method of processing plastic filaments, which includes "abrasive tumbling" to remove excess material.

A cold temperature tumbling process is described in U.S. Pat. 2,380,653 to Kopplin. According to this method, flash is removed from a molded article by tumbling the article in a rotatable container of dry ice and small objects, such as wooden pegs. The cold temperature resulting from the dry ice renders the flash material relatively brittle, such that the flash is more easily broken off of the article during the tumbling process.

U.S. Pat. 3,030,646 to Firestine, et al. describes a grinding and polishing method for optical glass, including glass lenses. The method includes a tumbling process wherein the glass articles are placed in a composition of a liquid, an abrasive and small pellets or other medium. The liquid is described as being water, glycerine, kerosine, light mineral oil and other organic liquids either alone or in combination; the abrasive is described as being garnet, corundum, boron carbide, quartz, aluminum oxide, emery or silicon carbide; and the medium is described as being ceramic cones, plastic slugs, plastic molding, powder, limestone, synthetic aluminum oxide chips, maple shoe pegs, soft steel diagonals, felt, leather, corn cobs, cork or waxes.

Another example of a tumbling process used in the manufacture of hard optical lenses (including certain types of intraocular lenses) made of hard lens material, such as hard plastic, is described in U.S. Pat. No. 4,541,206 to Akhavi and U.S. Pat. No. 4,580,371, also to Akhavi. These patents describe a lens holder or fixture used for holding a lens in a process of rounding the edge of an optical lens. The process includes an "abrasive tumbling" step carried out with an "abrasive medium" 70 in a tumbler 72.

Prior methods of removing flash, such as described above, may be inadequate or impractical in the manufacture of certain types of intraocular lenses (IOLs). For example, certain modern IOLs are formed with a relatively soft, highly flexible material, such as a silicone material, which is susceptible to chemical and/or physical changes when subjected to cold temperatures. Therefore, certain types of cryo-tumbling (or cold temperature tumbling) may be impractical in the manufacture of lenses made from such soft lens material. In addition, certain types of abrasive tumbling processes may be suitable for harder lens materials, such as glass or polymethylmethacrylate (PMMA), but may not be suitable for softer or foldable lens materials. Therefore, a need exists for a suitable process for removing flash, sharp edges and/or other irregularities from lenses made of a relatively soft or foldable lens material.

SUMMARY OF THE DISCLOSURE

The present invention relates to manufacturing processes for intraocular lenses (IOLs), tumbling processes used in the manufacture of IOLs and IOLs manufactured with such processes. According to an embodiment of the invention, a process for removing flash, sharp edges and/or other irregularities from a soft or foldable IOL involves a step of tumbling the IOL in a tumbling medium designed to be suitable for soft lens materials. The tumbling process utilizes glass beads which are preconditioned with a coating of abrasive material, such as a metal oxide, preferably, but not limited to, cerium oxide, zirconium oxide, chromium oxide, iron oxides, tin oxides, titanium dioxide, ytrium oxide, or aluminum oxide materials (including, but not limited to such aluminum oxide materials sold under the trademarks, Baik Alox™, $Alox_{721}$, $Alox_{722}$, XpaI™, and Opti-pol M™ which contains 40–50% $Al_2O_3$), or diatomaceous earth, Rhodite $90_{198}$ (rare earth oxide 15 mg/m$^3$, aluminum silicate 10 mg/m$^3$, thorium phosphate $1\times10-^{12}$ microcuries/mL-air, zinc sulfate 10 mg/m$^3$), or the like, and combinations thereof for purposes of tumbling.

According to a preferred embodiment, the lens is tumbled in a mixture of glass beads of first and second diameters, e.g., 0.5 mm and 0.3 mm diameter glass beads in a figure-8 tumbler. Beads with diameter 0.5 mm are used to tumble single piece lenses and beads with diameter 0.5 mm and 0.3 mm are used to tumble multipiece lenses. The tumbling mixture also includes alcohol and deionized water. A quantity of lenses which have been initially cleaned of heavy flash in the corner of the haptic area and on the lens periphery for multipiece and single piece (edge only) lenses are placed in the tumbling mixture and are tumbled at approximately 62 rpms for approximately 48 hours. The lenses may then be tumble-cleaned in a tumbling container containing non-conditioned beads (e.g., 0.5 mm optical grade glass beads), absolute alcohol and deionized water. The lenses are then separated from the tumbling medium, are soaked in alcohol and are ultrasonically cleaned. By this process, lenses made with soft, flexible lens material may be manufactured using a tumbling process for removing additional flash around haptic connection area and the lens peripheral surface. As a result, a reduction of the time required to remove flash from a soft lens is achievable.

Prior to tumbling the lenses, the glass beads are preconditioned in a preconditioning solution and deionized water to provide an abrasive coating on the beads. The preconditioning solution is a mixture of aluminum oxide, deionized water and glycerin. The beads are also reconditioned for reuse in tumbling. The beads are reconditioned in a manner similar to the manner for preconditioning.

BRIEF DESCRIPTION OF THE DRAWINGS

The detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
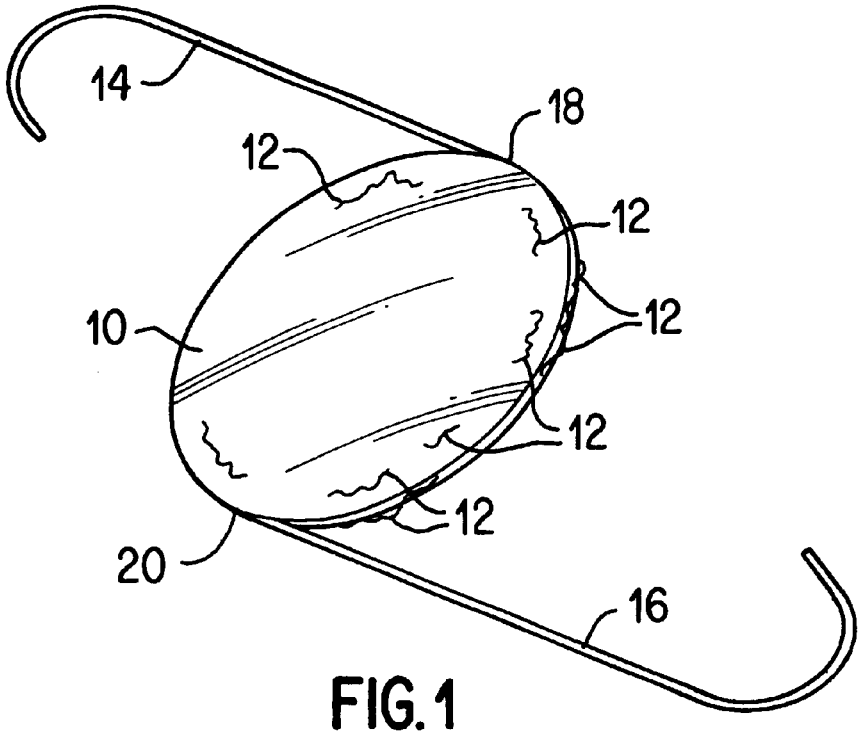
FIG. 1 is a prospective view of a multipiece lens with excess material or flash and other irregularities.

The following detailed description is of the best presently contemplated mode of carrying out the invention. This description is not to be taken in a limiting sense, but is made merely for the purpose of illustrating general principles of embodiments of the invention. The scope of the invention is best defined by the appended claims.

The present invention relates to manufacturing processes for intraocular lenses (IOLs), tumbling processes used in the manufacture of IOLs, and IOLs manufactured with such processes. According to embodiments of the invention, an IOL is manufactured according to a process which includes a molding step or other suitable manufacturing step for forming a rough lens, a flash-removing step for removing flash, sharp edges, rough surfaces and/or other irregularities from the lens and a lens cleaning step. According to embodiments of the invention, these steps are designed to be particularly well-suited for manufacturing soft or foldable IOLs, such as those made from soft or flexible lens materials. Thus, processes according to preferred embodiments of the present invention allow improved removal of flash, sharp edges, rough surfaces and/or other irregularities and processing of soft, flexible lenses. Such soft or foldable lenses may be made from a variety of suitable materials, including, but not limited to, silicone polymers, hydrocarbon and fluorocarbon polymers, hydrogels, soft acrylic polymers, polyesters, polyamides, polyurethanes, silicone polymers with hydrophilic monomer units, fluorine-containing polysiloxane elastomers and combinations thereof.

For example, suitable silicone polymers for soft lenses include, but are not limited to, poly(dimethylsiloxane-co-diphenylsiloxane) and poly(dimethylsiloxane). Suitable hydrocarbon and fluorocarbon polymers may include, but are not limited to, any one or combination of the following: polyethylene, polypropylene, polyisobutylene, polyisoprene, polybutadiene, poly(vinylidene fluoride), poly (vinylidene fluoride-co-hexafluoropropylene), poly (vinylidene fluoride-co-chlorotrifluoroethylene) and poly (tetrafluoroethylene-co-propylene).

Suitable hydrogels may include, but are not limited to, any one or combination of the following hydrated crosslinked polymers and copolymers of the following monomers: hydroxyethyl methacrylate, hydroxyethyl acrylate, hydroxypropyl methacrylate, hydroxypropyl acrylate, ethylene glycol mono- and dimethacrylates, ethylene glycol mono- and di- acrylates, N-vinyl pyrrolidinone, acrylic acid and its salts, methacrylic acid and its salts, acrylamide, methacrylamide, N-acryloyl morpholine, N-vinyl lactam, N-alkyl-N-vinylacetamides, and 2- and 4-vinylpyridines.

Suitable hydrogels may alternatively include, but are not limited to, one or combination of the following: hydrated crosslinked poly(vinyl alcohol), polyethylenimine and its derivatives, hyaluronic acid and its salts, and cellulose derivatives.

Suitable soft acrylic polymers may include, but are not limited to, one or combination of the following: polymers and copolymers of ethyl acrylate, propyl acrylate, n-butyl acrylate, isobutyl acrylate, n-hexyl acrylate, n-hexyl methacrylate, 2-ethylhexyl acrylate, 2-ethylhexyl methacrylate, n-octyl acrylate, n-octyl methacrylate, n-decyl acrylate, n-decyl methacrylate, n-dodecyl acrylate, n-dodecyl methacrylate, n-octadecyl acrylate, n-octadecyl methacrylate, trifluoroethyl acrylate, pentafluoropropyl acrylate, heptafluorobutyl acrylate and heptafluorobutyl methacrylate.

Suitable polyesters may include, but are not limited to, any one or combination of the following: poly(ethylene terephthalate) and poly(oxytetramethylene terephthalate-block-tetramethylene terephthalate). Suitable polyamides may include, but are not limited to nylon 66 and nylon 6. While the $T_g$ of these polymers are higher than room temperature, the polymers may be considered to be soft depending on the thickness of the lens. Thus, a thin lens made of these materials may be bendable as a soft lens.

Suitable polyurethanes may include, but are not limited to any one or combination of the following: polyurethane elastomers prepared from hydroxy-terminated polyesters, hydroxy-terminated polyethers, aliphatic, alicyclic or aromatic diisocyanates, and glycol chain extenders.

A lens is molded by providing a lens material (such as that described above) in a mold, curing or hardening the lens material within the mold, and removing the cured or hardened rough lens (10 in FIG. 1) from the mold. The molding process can be accomplished according to conventional impact molding processes or compression, injection or transfer molding. Alternatively, the lens may be manufactured according to other suitable manufacturing techniques, including, but not limited to, machining, casting and stamping from a film or the like.

Figure 3:
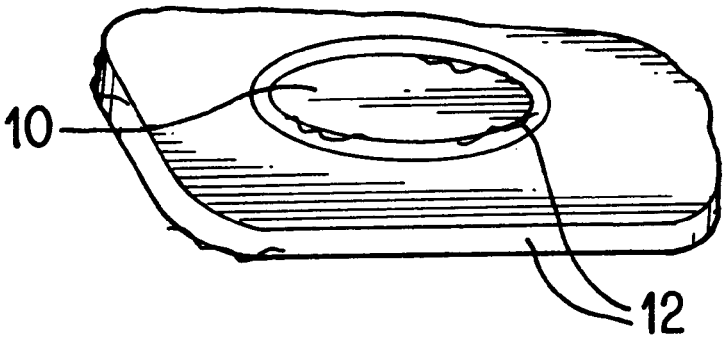
FIG. 3 is a prospective view of a single piece lens with excess material or flash and other irregularities.

As a result of the manufacturing process, excess material (flash) or other irregularities 12 may be formed around the periphery of the rough lens 10 and/or other irregularities may be formed on or around the optic portion of the rough lens, as shown in FIG. 1 and FIG. 3. Haptic elements 14 and 16 may be molded as part of, or otherwise attached to the lens at connection locations 18 and 20, respectively. In the past, removal of flash and other irregularities from a lens, especially around the haptic connection areas 18 and 20, has been relatively time-consuming and expensive.

Figure 2:
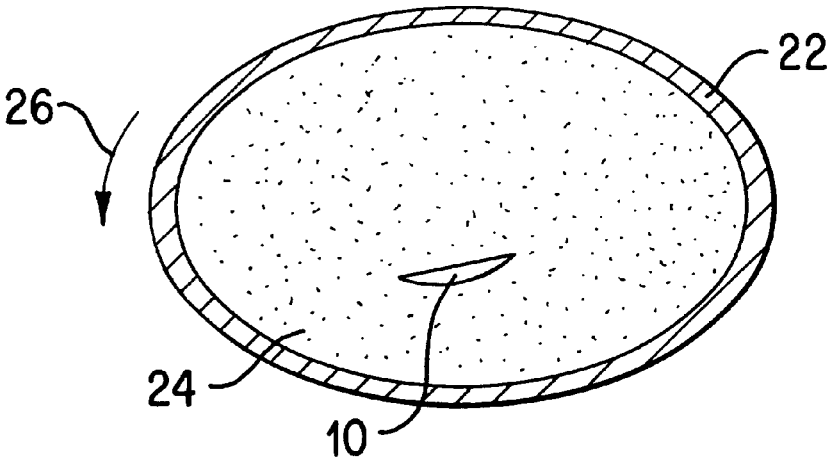
FIG. 2 is a schematic view of a lens and tumbling medium in a tumbling container.

According to embodiments of the present invention, a tumbling process designed to be compatible with soft lenses is employed to remove excess flash, sharp edges, rough surfaces and/or other irregularities from the manufactured lenses. Prior to the tumbling process, heavy flash build-ups, such as around the haptic connection areas 18 and 20, or at the periphery of multipiece and single piece lenses are removed, e.g., with a blade and/or tweezers. The lens is then placed in a tumbling container 22 (FIG. 2) having a tumbling medium 24 therein. The tumbling medium 24, according to embodiments of the invention, is designed to be compatible with soft lens material. In particular, the tumbling medium comprises a plurality of glass beads of first and second diameters, alcohol and deionized water. It has been found that the use of two different-sized glass beads with the alcohol and water solution will provide a suitable medium for tumbling lenses made of soft lens material.

In one embodiment, the glass beads comprise a plurality of glass beads having a 1 mm diameter and a second plurality of glass beads, having a 0.5 mm diameter. An example of the relative volumes of medium components, according to a preferred embodiment for sample rotational tumbling is as follows:

300 mL of 0.5 mm glass beads;

300 mL of 1.0 mm glass beads;

200 mL of pure ethyl alcohol; and 20 mL of deionized water.

For figure-8 rotational tumbling, a high percentage of glass beads is required.

Approximately 40–50 lenses may be placed in a tumbling container 22 having the above composition (and component volumes) of the tumbling medium therein. The tumbling machine is run at 80 rpm±20 rpms. for approximately 48–72 hours ±5 hours (e.g., the tumbling container 22 is rotated in the direction of arrow 26 at approximately 62 rpms. for 48 hours). Then, the tumbling machine is stopped and, preferably in a clean tumbling container is used for a tumble cleaning step, in which the lenses are tumbled with absolute alcohol and deionized water for a period of time. An example of the relative volumes of components of the medium for tumble cleaning, according to a preferred embodiment is as follows:

1300 g of 0.5 mm optical grade, non-conditioned glass beads;

350 g of alcohol; and 35 g of water. The tumble cleaning medium and lenses are tumbled, for example, for approximately 30 minutes at approximately 62 rpms. However, other suitable tumbling periods and rates may be employed.

After the tumble cleaning period expires, the tumbling machine is stopped and the lenses are separated from the tumbling medium. For example, with the figure-8 (multiple rotational axes) tumbling, a different speed and duration may apply.

The lenses are then subjected to a cleaning step, wherein the lenses are placed in a container of alcohol (an alcohol bath). In a preferred embodiment, the lenses and alcohol bath may be placed in an ultrasonic tank and cleaned, ultrasonically, for approximately twenty minutes.

In a preferred embodiment of the ultrasonic cleaning, 60 mL of isopropyl alcohol (IPA) is placed in a beaker containing a maximum of 50 lenses and sonicated for 20 minutes. In a further preferred embodiment, the IPA is then decanted and 60 mL of fresh IPA is added and sonicated for 15 minutes. The IPA is again decanted and 40 mL of fresh IPA is added.

As a result of the above process, a lens may be manufactured having relatively smooth surfaces and having minimal or no flash or other irregularities. Moreover, the above process is particularly well-suited for soft lens material which, heretofore, could not ordinarily be subjected to tumbling operations without severe damage to the soft lenses.

The above manufacturing steps and tumbling steps are particularly well-suited for soft IOL lenses, but may be used in the manufacture of other types of lenses as well. A soft IOL, e.g., made of soft lens material, as described above, can be manufactured according to the above-noted process, relatively economically, since the flash (and other irregularities) removal step is made much less labor-intensive by the unique tumbling process. When a tumbling process is employed in the manufacture of lenses having haptic elements connected thereto, it is desirable to reinforce the haptic connections.

Various aspects of the above manufacturing steps and tumbling steps are particularly well-suited for single piece and multi-piece UV and non-UV blocking soft IOLs. In a further preferred embodiment for tumbling (grinding) such single piece IOLs, a tumbling solution, comprising about 91% absolute alcohol and 9% deionized water, is mixed with approximately 1300 g of conditioned (as discussed below) glass beads of 0.5 mm diameter in a 1000 mL polyethylene jar. About 100–300 soft IOL lenses are placed in the jar for tumbling. The tumbling process is carried out in a figure-8 tumbler at 62 RPM for approximately 48 hours.

Although multiple lenses may be tumbled together, in preferred embodiments, at least a 2 diopter difference between groups of lenses exists. Thus, a plurality of, for example 10.0 diopter lenses may be tumbled together with a plurality of 12.0 diopter lenses, but preferably are not tumbled with 11 diopter lenses.

As noted above, the glass beads are conditioned with a coating of abrasive material, including, but not limited to such abrasive materials metal oxides, preferably, but not limited to, cerium oxide, zirconium oxide, chromium oxide, iron oxides, tin oxides, titanium dioxide, ytrium oxide, or aluminum oxide materials (including, but not limited to such aluminum oxide materials sold under the trademarks, Baik Alox ™, XpaI™, and Opti-pol M™ which contains 40–50% $Al_2O_3$), or diatomaceous earth, Rhodite 90™ (rare earth oxide 15 mg/m$^3$, aluminum silicate 10 mg/m$^3$, thorium phosphate $1\times10^{-12}$ microcuries/mL-air, zinc sulfate 10 mg/m$^3$), or the like, and combinations thereof, prior to being added to the tumbling container. The preconditioning of the beads is carried out in order to smooth the otherwise relatively rough surfaces of the beads, yet provide the beads with sufficient abrasiveness to remove excess flash and some further lens material from the IOLs during the tumbling process. This provides significant benefits in the manufacture of soft IOLs, in that the relatively soft material used in the optic of such lenses can be easily scratched or marred by overly abrasive beads, while non-abrasive beads may not sufficiently remove flash and other irregularities or smooth sharp edges or rough surfaces. It is noted that pre-conditioned beads as discussed herein provide the above mentioned benefits and also grind and remove a small amount of material from the optical surface, preferably sufficient to render the IOL's radius of curvature slightly smaller, causing an upward shift in diopter.

Figure 4:
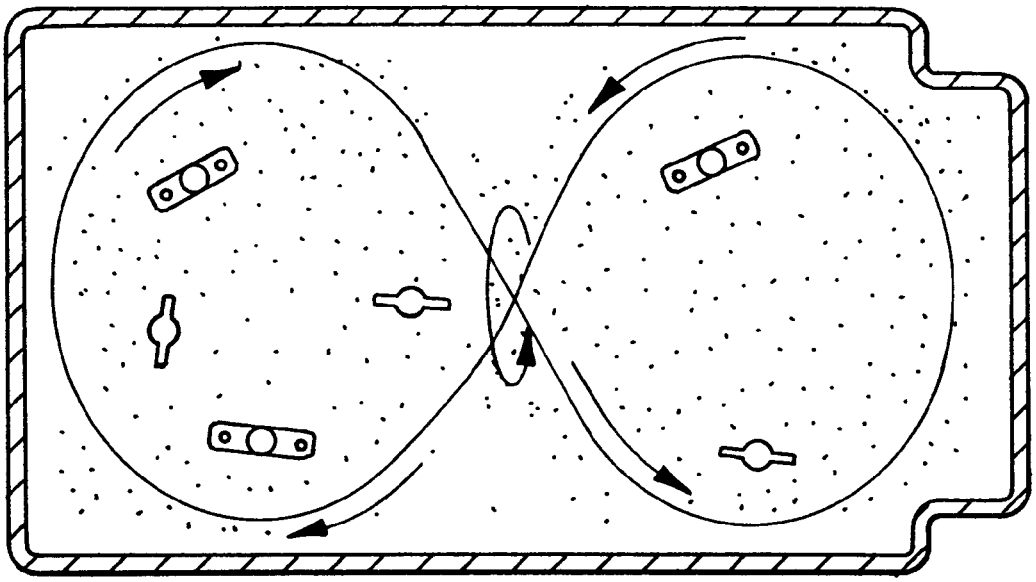
FIG. 4 is a cross section of a figure-8 tumbler.

According to one embodiment, bead pre-conditioning steps comprise a five day cycle. In particular, the beads are tumbled (preferably in a "figure-8" tumbler, such as shown in FIG. 4) in a mixture of diatomaceous earth and alcohol (such as IPA) for approximately 3 days. Then the beads are subjected to two approximately 24-hour cycles of rinsing in alcohol. Next, the beads are tumbled in a mixture of an abrasive material as discussed above, (preferably a powdered metal oxide, such as aluminum oxide or other materials discussed above) and alcohol for approximately 6 hours. This pre-conditioning process applies a layer of abrasive material on the glass beads and renders the beads abrasive to the desired degree for tumble processing soft IOLs.

The beads, after being pre-conditioned, are then suitable for approximately three separate IOL tumbling processes, e.g., in a figure-8 tumbler for approximately 48 hours per tumbling process, as discussed above. Following the three separate IOL tumbling processes, the beads may be re-conditioned in the same manner as discussed above with respect to the pre-conditioned steps. The use of a figure-8 tumbler provides significant benefits in that the rotation about multiple rotation axes increases the occurrences and angles of engagement of the beads with the lenses. However, further embodiments may employ tumbling devices other than a figure-8 tumbler.

A further embodiment of pre-conditioning for glass beads used to tumble (grind) silicone intraocular lenses includes three general processes, namely preparing the conditioning solution or agent, preconditioning the beads and cleaning the beads.

In preferred embodiments, aluminum oxide is used as the abrasive coating material, although other abrasive materials as discussed above may alternatively be used in a similar manner. The conditioning solution or agent consists essentially of the following ingredients for a 2000 g quantity: 528 g (26.40%) of aluminum oxide type 721; 151 g (7.54%) deionized water (WFI), USP; and 1321 g (66.06%) glycerin, USP. Initially, the water is heated to 70° C. Next, the water is stirred and ⅓of the glycerin is added approximately every 5 minutes. While continuing to stir, the aluminum oxide powder is slowly added until a homogeneous paste is formed. The solution is then allowed to mix for a minimum of 1 hour.

After the conditioning solution or agent is prepared the tumbler is set at 62 RPM. A clean 1000 mL polyethylene jar is prepared and the following ingredients are then placed into the jar: 1300 g of unconditioned 0.5 mm glass beads or 1200 g of a combination of 800 g of 0.5 mm and 400 g of 0.3 mm unconditioned glass beads; 300 g of conditioning solution or agent; and 150 g of deionized water. The lid is secured on the jar and the jar is placed in the tumbling machine. The tumbler is allowed to run for 48 hours.

Once the tumbling cycle is complete, the lid is removed and its contents are poured into a #60 sieve. The beads are then rinsed with deionized water until the water comes out of the sieve slightly cloudy. The beads are then poured into an aluminum pan and dried at 120° C. in a drying oven for 10 hours.

After the beads have been dried they are poured into a series of sieves and a catch pan. The sieves and catch pan are specifically ordered top to bottom as follows: #40, #60 and a catch pan. The beads are poured into the top sieve.

Once the beads are poured into the top sieve, the top sieve is covered and the series of sieves is placed onto a shaking machine and shaken for about 10 minutes. At the conclusion of the shaking, the sieves are disassembled. The contents of each sieve is emptied into an appropriate bead size container. The beads collected in the catch pan are discarded. Beads are inspected microscopically. Only beads with a thin film of abrasive material are used for tumbling the soft IOLs.

Re-conditioning of previously used beads may be similar to the steps employed during pre-conditioning. However, in preferred embodiments, some differences in the process do exist. These differences are enumerated below.

In preferred embodiments, aluminum oxide is used as the abrasive coating material; however, other abrasive materials as discussed above may be used. For reconditioning glass beads, a reconditioning solution or agent is used, which consists essentially of the following ingredients: 1091 g (54.55%) glycerin, USP; 455 g (22.73%) aluminum oxide type 721; and 454 g (22.72%) deionized water, WFI.

The water, and glycerin are stirred together until a homogenous solution develops. One third of the aluminum oxide is then added about every 10 minutes while stirring. The solution is allowed to mix for a minimum of 1 hour or until the solution becomes completely homogenous.

In an example bead reconditioning step, the following components are placed in the 1000 mL polyethylene jar: 1300 g of previously used (3 times) 0.5 mm glass beads, or 1200 g of a combination of 800 g of previously used (3 times) 0.5 mm glass beads and 400 g of previously used (3 times) 0.3 mm glass beads; 204 g reconditioning solution or agent; and 204 g deionized water. The jar with the above solution is tumbled for 8 hours. In the preferred embodiment, the glass beads should not be used in a lens tumbling process more than twice before reconditioning.

The bead cleaning step is as described above for pretreatment of beads. The acceptance criteria for use in tumbling is also as stated above.

The above described conditioning and reconditioning of the beads is advantageous in that it results in beads with an abrasive quality. The use of glycerin in the preconditioning process has been found to improve the quality of the abrasive coating. The abrasive quality is advantageous during lens tumbling in that it improves flash removal and the ability to smooth rough surfaces and sharp edges.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being illustrated by the appended claims, rather than the foregoing description, and all changes which come within the meaning and range of equivalency of the claims are therefore intended to be embraced therein.

What is claimed is:

1. A method of processing a lens made of soft or foldable lens material, the method comprising the steps of:

applying a coating of abrasive material to a plurality of beads, wherein the abrasive material comprises cerium oxide, zirconium oxide, chromium oxide, iron oxides, tin oxides, titanium dioxide, ytrium oxide, or diatomaceous earth;

containing the coated beads in a tumbling container;

adding at least one soft or foldable lens to the tumbling container; and tumbling the soft or foldable lens with the coated beads.

2. A method as claimed in claim 1, wherein the beads comprise glass beads.

3. A method as claimed in claim 1, wherein the tumbling container comprises a figure-8 tumbler container.

4. A method as claimed in claim 1, wherein the step of applying a coating of abrasive material on the beads comprises the steps of:

tumbling the beads in a mixture of diatomaceous earth and alcohol;

rinsing the beads with alcohol following the bead tumbling step; and tumbling the rinsed beads in a mixture of alcohol and at least one of cerium oxide, zirconium oxide, chromium oxide, iron oxides, tin oxides, titanium dioxide, ytrium oxide, or diatomaceous earth.

5. A method as claimed in claim 1, wherein the step of applying a coating of abrasive material on the beads comprises the step of tumbling the beads in a mixture of alcohol and at least one of cerium oxide, zirconium oxide, chromium oxide, iron oxides, tin oxides, titanium dioxide, ytrium oxide, or diatomaceous earth.

6. A method as claimed in claim 1, wherein the soft or foldable lens material is selected from the group consisting of silicone polymers, hydrocarbon polymers, fluorocarbon polymers, hydrogels, soft acrylic polymers, polyesters, polyamides, polyurethanes, silicone with hydrophilic monomer units, fluorine-containing polysiloxane elastomers and collagen copolymers.

7. A method as claimed in claim 1, wherein the soft or foldable lens material is a silicone polymer.

8. A method as claimed in claim 1, wherein the soft or foldable lens material is a hydrocarbon polymer.

9. A method as claimed in claim 8, wherein the hydrocarbon polymer lens material is selected from the group consisting of polyethylene, polypropylene, polyisobutylene, polyisoprene and polybutadiene.

10. A method as claimed in claim 1, wherein the soft or foldable lens material is a fluorocarbon polymer.

11. A method as claimed in claim 10, wherein the fluorocarbon polymer lens material is selected from the group consisting of poly(vinylidene fluoride), poly(vinylidene fluoride-co-hexafluoropropylene), poly(vinylidene fluoride-co-chlorotrifluoroethylene) and poly(tetrafluoroethylene-co-propylene).

12. A method as claimed in claim 1, wherein the soft or foldable lens material is a hydrogel.

13. A method as claimed in claim 12, wherein the hydrogel lens material is selected from the group consisting of hydrated crosslinked polymers and copolymers of the following monomers: hydroxyethyl methacrylate, hydroxyethyl acrylate, hydroxypropyl methacrylate, hydroxypropyl acrylate, ehtylene glycol mono- and di-methacrylates, ehtylene glycol mono- and di- acrylates, N-vinyl pyrrolidinone, acrylic acid and its salts, methacrylic acid and its salts, acrylamide, methacrylamide, N-acryloyl morpholine, N-vinyl lactam, N-alkyl-N-vinylacetamides, and 2- and 4-vinylpyridines.

14. A method as claimed in claim 12, wherein the hydrogel lens material is selected from the group consisting of hydrated crosslinked poly(vinyl alcohol), polyethylenimine and its derivatives, hyaluronic acid and its salts, and cellulose derivatives.

15. A method as claimed in claim 1, wherein the soft or foldable lens material is a soft acrylic polymer.

16. A method as claimed in claim 15, wherein the soft acrylic polymer lens material is selected from the group consisting of polymers and copolymers of ethyl acrylate, propyl acrylate, n-butyl acrylate, isobutyl acrylate, n-hexyl acrylate, n-hexyl methacrylate, 2-ethylhexyl acryltate, 2-ethylhexyl methacrylate, n-octyl acrylate, n-octyl methacrylate, n-decyl acrylate, n-decyl methacrylate, n-dodecyl acrylate, n-dodecyl methacrylate, n-octadecyl acrylate, n-octadecyl methacrylate, trifluoroethyl acrylate, pentafluoropropyl acrylate, heptafluorobutyl acrylate and heptafluorobutyl methacrylate.

17. A method as claimed in claim 1, wherein the soft or foldable lens material is a polyester.

18. A method as claimed in claim 17, wherein the polyester lens material is selected from the group consisting of poly(ethylene terephthalate) and poly(oxytetramethylene terephthalate-block-tetramethylene terephthalate).

19. A method as claimed in claim 1, wherein the soft or foldable lens material is a polyamide.

20. A method as claimed in claim 19, wherein the polyamide lens material is selected from the group consisting of nylon 66 and nylon 6.

21. A method as claimed in claim 1, wherein the soft or foldable lens material is a polyurethane.

22. A method as claimed in claim 21, wherein the polyurethane lens material is selected from the group consisting of polyurethane elastomers prepared from hydroxy-terminated polyesters, hydroxyterminated polyethers, aliphatic, alicyclic or aromatic diisocyanates, and glycol chain extenders.

23. A method of processing a lens body made of soft or foldable lens material, the method comprising the steps of:

containing a solution and beads coated with an abrasive material comprising cerium oxide, zirconium oxide, chromium oxide, iron oxides, tin oxides, titanium dioxide, ytrium oxide, or diatomaceous earth, or combinations thereof, in a tumbling container;

adding at least one soft or foldable lens to the tumbling container; and tumbling the soft or foldable lens with the coated beads to remove irregularities and at least some lens material from the soft or foldable lens.

24. A method as claimed in claim 23, wherein the soft or foldable lens material is selected from the group consisting of at least one of silicone polymers, hydrocarbon polymers, fluorocarbon polymers, hydrogels, soft acrylic polymers, polyesters, polyamides, polyurethanes, silicone with hydrophilic monomer units, fluorine-containing polysiloxane elastomers and collagen copolymers.

25. A method as claimed in claim 23, wherein the beads comprise glass beads.

26. A method of processing a lens made of soft or foldable lens material, the method comprising the steps of:

containing a solution and beads coated with an abrasive material in a tumbling container, wherein the abrasive material comprises Rhodite 90;

adding at least one soft or foldable lens to the tumbling container; and tumbling the soft or foldable lens with the coated beads to remove irregularities and at least some lens material from the soft or foldable lens.

* * * * *